US009745745B2

(12) United States Patent
Lillette et al.

(10) Patent No.: US 9,745,745 B2
(45) Date of Patent: Aug. 29, 2017

(54) CEILING FRAMEWORK

(71) Applicant: PLAFOMETAL, Montherme (FR)

(72) Inventors: Matthieu Lillette, Laifour (FR); Phillippe Riggi, Charleville Mezieres (FR); Xavier Turot, Charleville Mezieres (FR)

(73) Assignee: PLAFOMETAL, Montherme (FR)

( * ) Notice: Subject to any disclaimer, the term of this patent is extended or adjusted under 35 U.S.C. 154(b) by 0 days.

(21) Appl. No.: 15/071,031

(22) Filed: Mar. 15, 2016

(65) Prior Publication Data

US 2016/0194873 A1 Jul. 7, 2016

Related U.S. Application Data

(63) Continuation of application No. 13/882,388, filed as application No. PCT/FR2011/000580 on Oct. 28, 2011, now Pat. No. 9,315,991.

(30) Foreign Application Priority Data

Oct. 29, 2010 (FR) ..... 10 04283

(51) Int. Cl.
*E04B 9/06* (2006.01)
*E04B 9/08* (2006.01)
(Continued)

(52) U.S. Cl.
CPC ..... *E04B 9/06* (2013.01); *E04B 1/941* (2013.01); *E04B 1/98* (2013.01); *E04B 9/067* (2013.01); *E04B 9/08* (2013.01); *E04B 9/122* (2013.01)

(58) Field of Classification Search
CPC ... E04B 9/30; E04B 9/18; E04B 9/064; E04B 9/067; E04B 9/0478; E04B 9/225; E04D 15/025
(Continued)

(56) References Cited

U.S. PATENT DOCUMENTS 3,015,375 A 1/1962 Lickliter et al.
3,119,475 A 1/1964 Adams
(Continued)

FOREIGN PATENT DOCUMENTS

EP 1 640 523 3/2006
GB 2 401 121 A 11/2004

OTHER PUBLICATIONS

International Search Report Issued Mar. 2, 2012 in PCT/FR11/00580 Filed Oct. 28, 2011.
European Search Report issued Nov. 11, 2015 in Patent Application No. 15173993.5 (with English translation of categories of cited documents).

*Primary Examiner* — Paola Agudelo
(74) *Attorney, Agent, or Firm* — Oblon, McClelland, Maier & Neustadt, L.L.P.

(57) ABSTRACT

A ceiling framework includes main beams and cross beams, which are connected to one another and transversally to one another by connectors borne by one type of beams among the main beams and the cross beams, and engaged in apertures made in the other type of beams among the main beams and the cross beams, so as to receive tiles. For each beam having the apertures, the apertures are marked with symbols on each face of the beam, the symbols marked on each face being repeated sequentially over the length of the beam, the period of the sequences of symbols on each face being equal to a given tile size. The marking is the same on either face of the beam, starting with the same symbol on each left-hand or right-hand end for each observed face.

12 Claims, 4 Drawing Sheets

Figure 1:
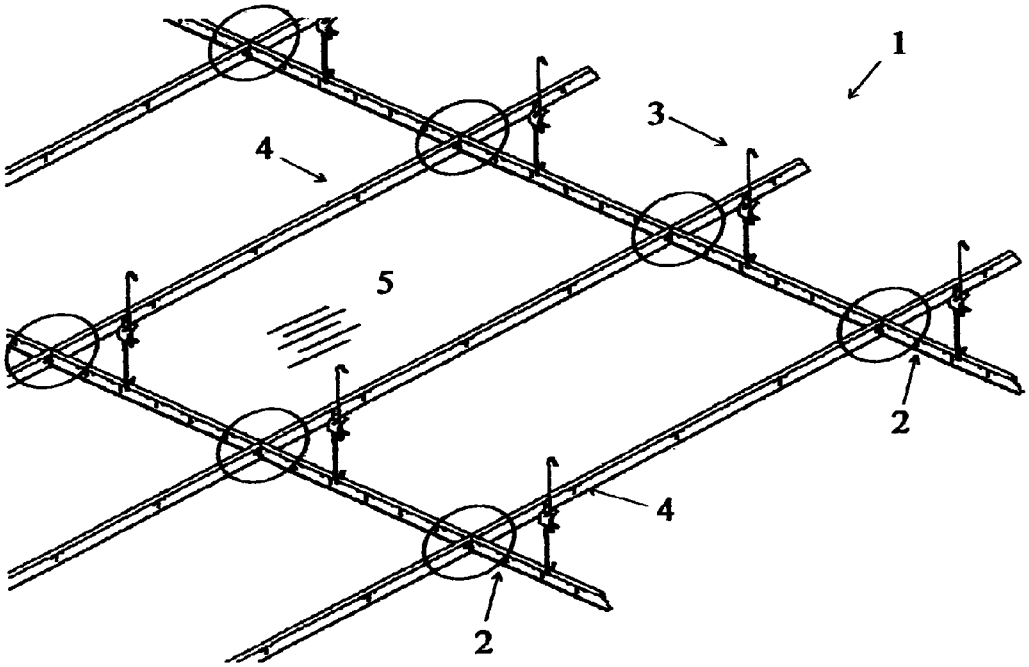

(51) Int. Cl.
*E04B 9/12* (2006.01)
*E04B 1/94* (2006.01)
*E04B 1/98* (2006.01)

(58) Field of Classification Search
USPC ..... 52/173.3, 105
See application file for complete search history.

(56) References Cited

U.S. PATENT DOCUMENTS 3,270,421 A * 9/1966 Jones ..... G06G 1/0021 33/759
3,294,428 A 12/1966 Lickliter et al.
3,367,695 A 2/1968 Haertel et al.
3,654,849 A 4/1972 Shepherd
4,043,689 A 8/1977 Spencer et al.
5,839,246 A * 11/1998 Ziegler ..... E04B 9/068 403/347
5,966,887 A 10/1999 Mieyal
6,199,343 B1 3/2001 Sauer et al.
7,150,128 B2 * 12/2006 Schuman ..... E04B 5/12 33/563
7,634,881 B2 12/2009 Ahren et al.
7,661,236 B2 2/2010 Platt et al.
8,511,028 B2 8/2013 Lehane, Jr.
2002/0083669 A1 * 7/2002 Paul ..... E04B 9/122 52/506.06
2003/0154664 A1 * 8/2003 Beck ..... E04D 3/30 52/105
2004/0194417 A1 * 10/2004 Paul ..... E04B 9/067 52/716.8
2005/0166509 A1 8/2005 Sareyka et al.
2005/0166523 A1 8/2005 Platt et al.
2006/0260244 A1 11/2006 Platt et al.
2008/0110122 A1 * 5/2008 Lehane ..... E04B 9/122 52/506.07
2009/0293403 A1 12/2009 Cedrone et al.
2010/0294521 A1 11/2010 Thompson
2011/0088350 A1 4/2011 Lehane et al.
2011/0239576 A1 10/2011 Dallan

* cited by examiner

CEILING FRAMEWORK

CROSS-REFERENCE TO RELATED APPLICATIONS

The present application is a continuation application of U.S. patent application Ser. No. 13/882,388, filed on Apr. 29, 2013, which is a National Stage Application of International Application No. PCT/FR11/000580, filed on Oct. 28, 2011, and which claims the benefit of foreign priority to French Application No. FR 10 04283, filed on Oct. 29, 2010. The entire contents of each of the above applications are hereby incorporated by reference in entirety.

The present invention relates to a bearing metal framework system for a suspended ceiling or false ceiling of a building and more specifically relates to the connectors used for assembling the elements of this framework.

A suspended ceiling or false ceiling is made up of a latticework of metal profile sections forming a bearing framework and of tiles resting in each space of this framework. The metal framework is generally suspended from the main ceiling of the shell of the building by hangers.

Usually, the latticework of metal profile sections is formed of bearing main beams that run the entire length of the room that is to be equipped or which are joined together in such a way as to cover this length, in theory parallel to one another, and of secondary beams or cross beams, in theory parallel to one another and perpendicular to the main beams. These cross beams are in sections the length of the spacing between the main beams and are connected to the main beams, or even connected to the adjacent aligned cross beams. Main beams and secondary beams are joined together, or secondary beams are joined to one another, by means of orifices or apertures pierced in the main beams on the one hand, and of connectors on the other hand, arranged at the ends of the sections of secondary beams and entering the apertures in the main beams so as to be connected therewith, or even so as to be interconnected with the connectors of the aligned secondary beams in the spaces between adjacent main beams.

Throughout the following the expression false ceiling or suspended ceiling should be understood in the broadest sense and the invention will cover all instances of ceilings borne by a metal framework whether or not there is a main ceiling, whether the framework is suspended from the main shell of the building or attached in a different way, for example resting on supports, and whether or not the various beams of the framework are mutually parallel.

Patent document EP1724407 in particular discloses systems in which the connectors are simple hooks at the ends of the cross beams, which enter apertures in the main beams and become anchored therein. Sometimes this hook shape is created in the material of the cross beam without any need for a connector attached to the end of the cross beam. Such systems do not provide for interconnection between the connectors of two contiguous aligned cross beams. The connections have no clearance except possibly a small clearance of the order of 0.1/0.2 mm intended to absorb any dimensional variations caused by manufacturing tolerances and thus avoid any combination of variations from the nominal dimensions which combinations might render connection impossible or lead to a modification in the nominal mesh spacing making it impossible for the ceiling tiles to be inserted. These are the systems known as "hook on" systems.

Other systems referred to as "stab-in" or "harpoon" systems are also known, notably from patent documents EP1640523, EP1553239 and EP857243, and in these systems connection is had by thrusting the end of the cross beam fitted with its connector into the aperture of the main beam with a movement perpendicular to said main beam and resembling a stabbing action, thus in a single action anchoring into the main beam and making the connection with the adjacent cross beam. The shape of the connector may also be produced directly in the material of the end of the cross beam, but usually an attached connector is preferred which may thus be made of a harder metal which is therefore more able to withstand the "stabbing action" involved in connection. In these "stab-in" systems a non-return means is provided so that connectors that have entered the aperture of a beam cannot come back out again. These non-return means adopt various forms: they may be a cutout of a wedge of metal made in the connector which jams in the aperture; they may be a step on the periphery of the connector followed by a notch in which the upper part of the aperture becomes immobilized, etc. These "stab-in" systems generally allow interconnection between the connectors of two aligned cross beams engaged in one and the same aperture. In addition, in these "stab-in" systems the connection is practically free of clearance except possibly for a clearance of 0.1/0.2 mm in order to absorb possible manufacturing variations.

Each of these two, "hook-on" and "stab-in", systems has also been improved to enhance the fire resistance of the metal frameworks. In the heat of a fire, the metal parts expand and in the absence of preventive means the framework deforms, the false ceiling is no longer fluid-tight, then the connections yield, causing the tiles of the false ceiling to drop out thus no longer preventing the temperature of the main ceiling from increasing. As far as the main beams are concerned, it is commonplace for these to be equipped with zones or junctions capable of deforming and of distorting in a controlled fashion in order to absorb the elongation, as described in patent document FR2569747. In the case of the cross beams, the problem is a different one insofar as an entire line of cross beams is made up of a plurality of separate sections and it is not possible for the same solution as was used for the main beams to be applied here unless each section is thus equipped, but in such a case the correction applied is not suited to the length of the section. Further, the solution of the zone which distorts or undergoes controlled deformation comes into operation only once a relatively high thrust force has been exceeded, and before that happens, the connections will have become damaged or the cross beams will have become deformed.

In an attempt to overcome this fire problem, patent document EP1724407 describes a "hook-on" system with metal connectors at the ends of the cross beams, which are coated with a plastic material which forms the elements and stops necessary for the correct positioning and catching in the main beams, which means for positioning without excessive clearance and at the same time preventing the said connector from penetrating too far into the main beam at normal service temperatures. This plastic coating melts in the event of a fire, thus freeing the connector of its plastic elements and end stops which were positioning it, and therefore allowing it to penetrate further into the aperture of the main beam in order to absorb the elongation caused by thermal expansion and thus preventing the deformations of the metal framework which would have caused it to fall with the effect that the fire is no longer contained by the suspended ceiling and is free to spread.

The plastic coating is incompatible with the requirements of mechanical robustness and accuracy of positioning under normal circumstances. In particular, it is difficult to comply with the earthquake recommendations which, in the USA, demand a tensile and compressive strength of at least 180 pounds, namely around 80 kg, with a maximum misalignment of 5°. As this system is a "hook-on" system, there is no interconnection between two aligned cross beams and this means that tension cannot be spread across all of the connections of a whole line of cross beams but affects only the connection closest to the point at which the tension is applied, which is unable to resist and causes the framework to become detached.

Another known document, patent document U.S. Pat. No. 3,294,428, proposes an assembly which has connecting pieces between its various portions of cross beams which are arranged between bearing beams, able to slide in a longitudinal recess at the end of the cross beams when the heat of a fire has caused fusible shims interposed in the fixing of the connecting pieces to the cross beams to have melted. Thus, in the event of a fire, the tight connection of the connecting pieces becomes loose, and the cross beams can undergo thermal expansion without being restricted by fixed connecting points. However, even with its anti-fire system, this assembly is unsatisfactory insofar as it does not enjoy the catching safety and practicality of the "hook-on" or "stab-in" systems. Further, the fact that it has different catching systems for each end of the cross beams complicates assembly and these systems are not designed for high precision, these being factors that make these systems all the more incompatible with present-day requirements.

The applicant company, facing the problem of fire resistance and resulting thermal expansion and seeking at the same time a system that meets earthquake recommendations, is seeking precise mechanical positioning and superior robustness which are incompatible with the use of plastics.

It also seeks a system that provides for convenient, quick and easy installation capable also of allowing correct connection to be checked without loss of time.

To this end, the invention proposes a connector for a ceiling framework formed of crisscrossed main beams and secondary beams or cross beams, to be mounted on the cross beams, intended to make the connection between the different beams using the "stab-in" system, characterized in that it comprises two parts, a primary clip and a secondary clip, which are associated with one another via a fusible means capable of melting at the temperature of a fire so as to cause said two parts to separate.

The fusible means is a braze material which melts at a temperature that can be chosen to suit the requirements and which is generally chosen to be below 300° C.

The primary clip has a shape, notably an elongate notch on its periphery allowing clearance in the connection, corresponding to the dimensional variation of the beams that are to be absorbed in the event of a fire, the secondary clip having a solid region positioned facing the notch and which fills it when the primary and secondary clips are combined.

The two component parts of the proposed connector are made of metal and have different compositions and/or thicknesses and/or treatments so that they spread the various functions of the connector between them, each being tailored to suit different specific functions so that additional functions can also be introduced or, better still, performed, notably acoustic inspection to check the correct connection.

The primary clip is made of a composition and has a thickness which are suited to ensuring the mechanical robustness of the ceiling and to allowing interconnection, the secondary clip being of a composition and of a thickness suited to ensuring the precision of the positioning, to limiting forward and back movements in the beam, and to performing other functions connected with its elasticity.

In order to allow connection of two opposite connectors, the primary clip of each connector has a recess and is equipped on one of its faces with a protrusion, said protrusion being on the face that has no secondary clip, the protrusion of one of the connectors being intended to be immobilized in the recess of the opposite connector, thus connecting them.

In order to protect the secondary clip from any knock that might damage it, the front of the connector has bosses on that face of the primary clip to which the secondary clip is fixed, and the tops of the bosses protrude beyond the free surface of the front of the secondary clip.

Combining the two clips makes it possible to reconcile two requirements which are normally incompatible: the extreme precision of assembly resulting from an absence of clearance or from a very small clearance and the possibility of absorbing significant thermal expansions such as those which occur in the event of a fire by having available a clearance which this time needs to be great.

This possibility of resorting to two different components allows greater quality and greater ease of assembly, greater robustness of connection, etc. than in a system with a single-piece connector which can do nothing more than reach a compromise in an attempt to satisfy incompatible requirements.

The invention also proposes a metal framework for a ceiling.

The invention also indicates how to dismantle an assembly of connected main beams/cross beams.

The invention makes it possible to create frameworks for ceilings with clearances under normal service conditions, namely when there is no fire, which are zero or small, therefore not exceeding 0.2 or even 0.1 mm, while at the same time being capable of absorbing thermal expansions caused by a fire.

The invention applies to the creation of ceilings according to the earthquake recommendations which prescribe a tensile and compressive strength of at least 180 pounds, namely approximately 80 kg.

Figure 2:
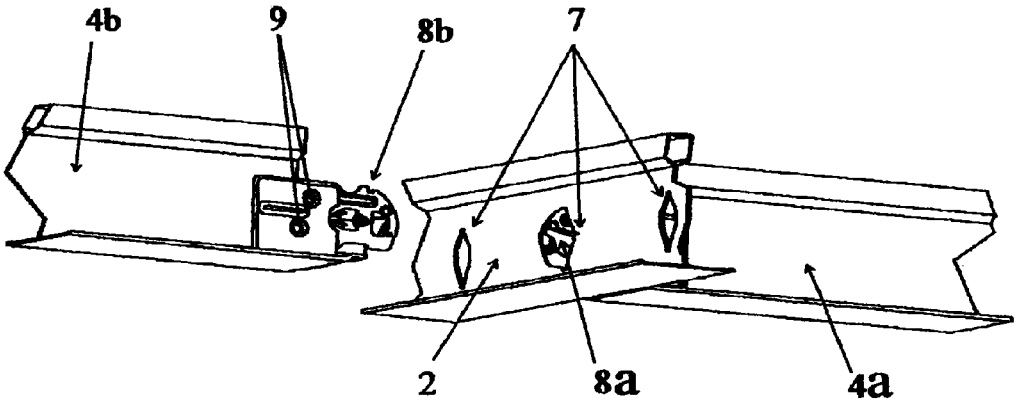
Figure 3:
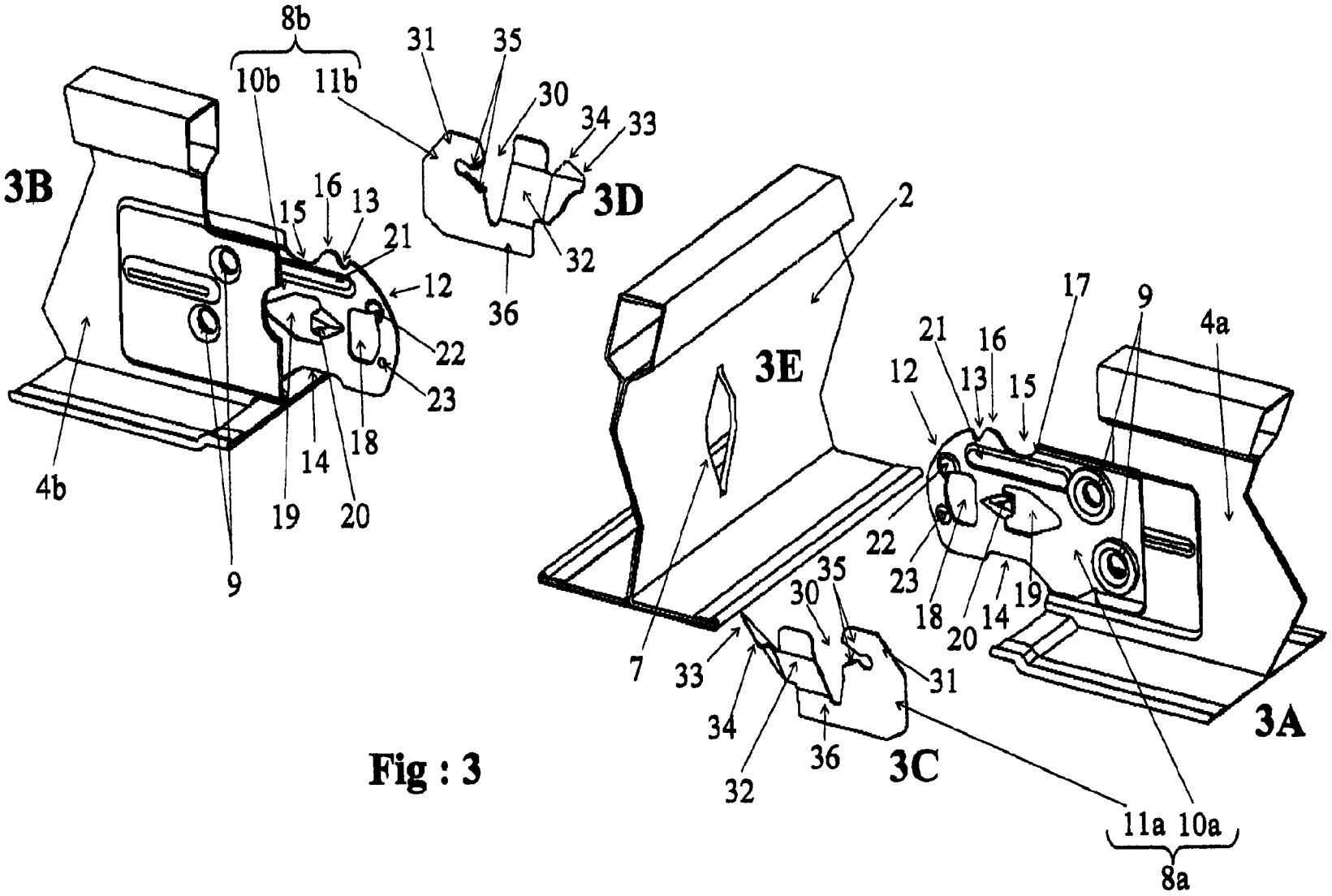
Figure 4:
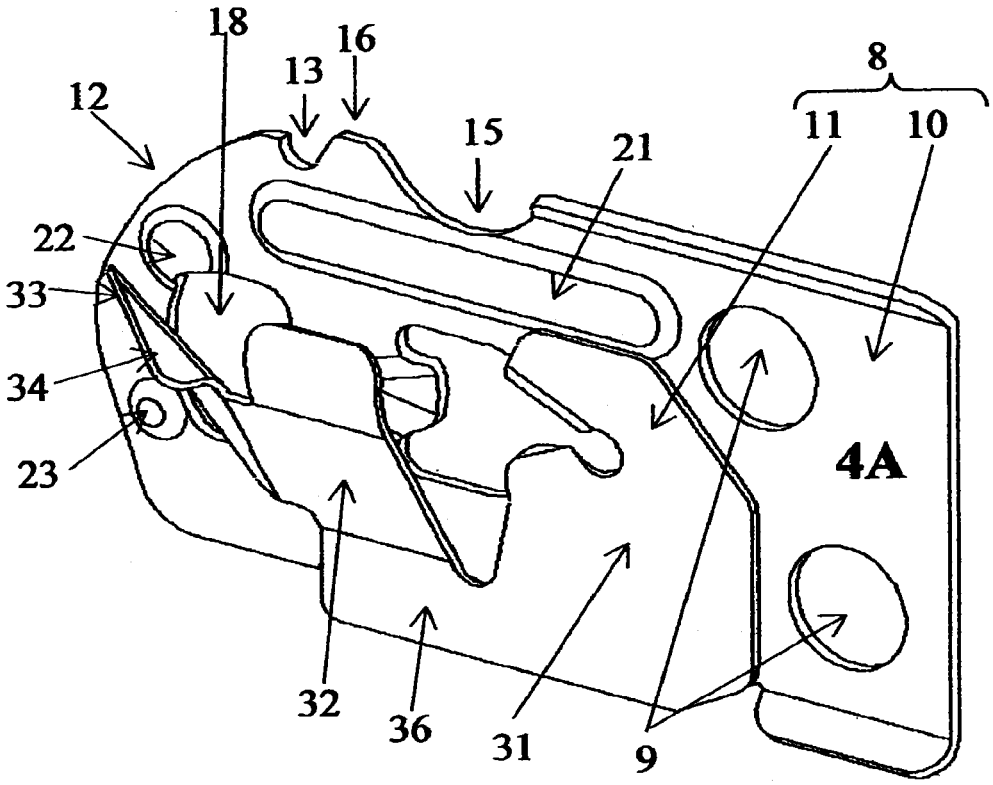
Figure 4:
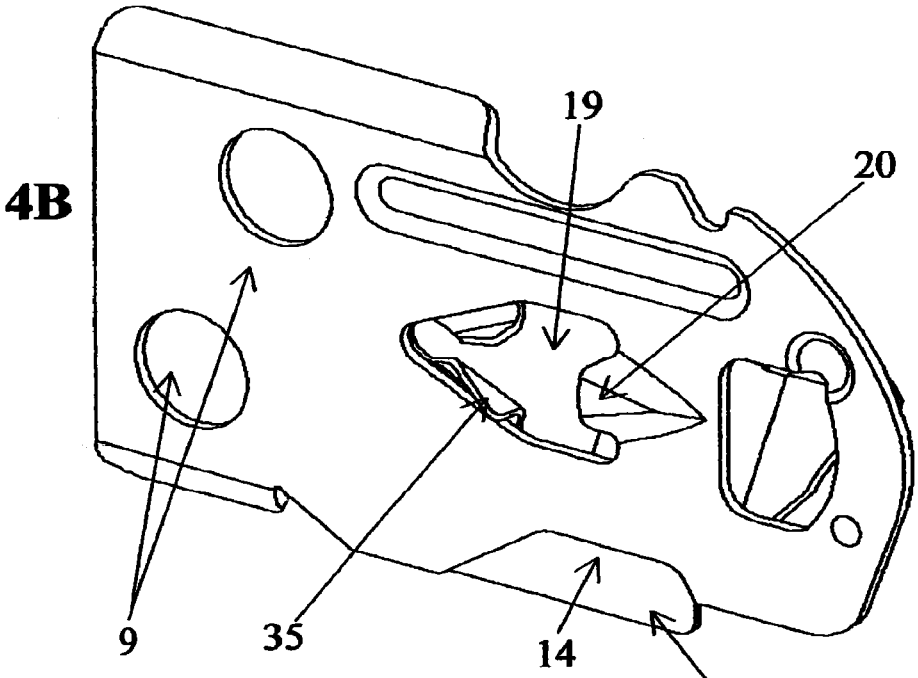
Figure 5:
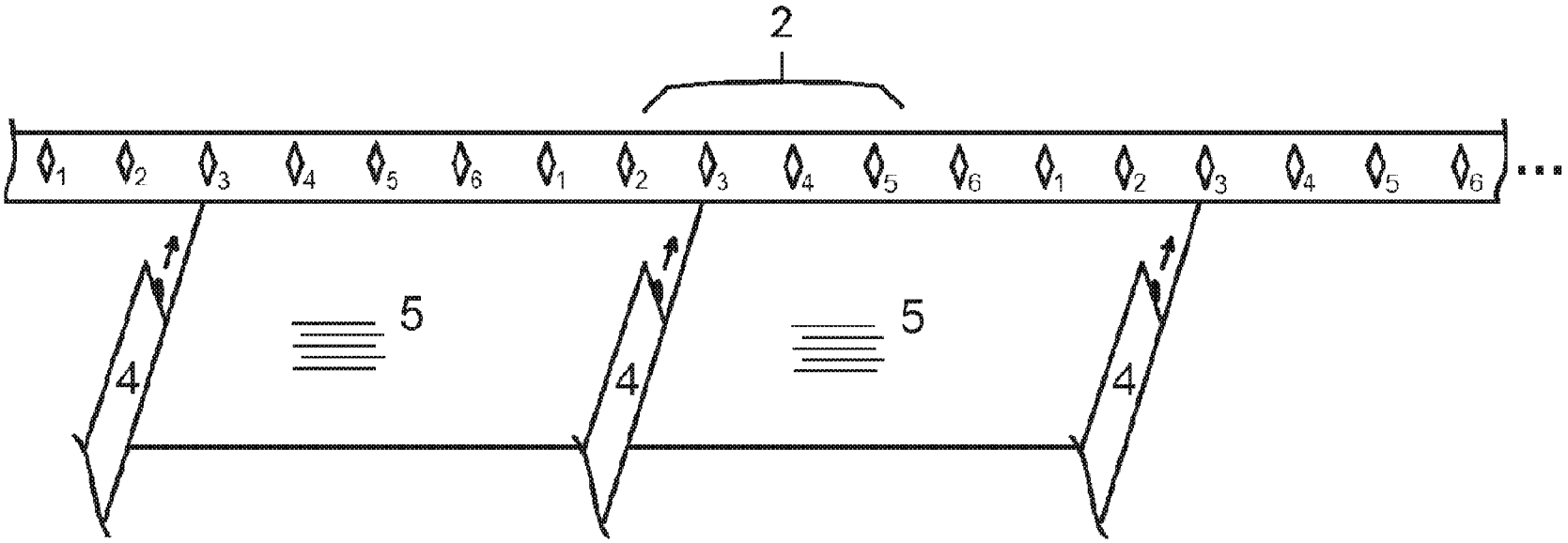

The invention will now be described in greater detail with reference to the attached figures which depict:

FIG. 1: a portion of the latticework of a metal framework for a suspended ceiling, FIG. 2: a more detailed view of a portion of a bearing beam and of two cross beams which are intended to be connected thereto and equipped with their connectors according to the invention, FIG. 3: an exploded view in the region of a connection of two cross beams, each equipped with a two part connector, with a main beam, comprising a view 3A of an end of a cross beam with a part of its connector, a view 3B of the end of the opposite cross beam with a part of its connector, a view 3C with the second part of the connector intended to complete view 3A, a view 3D with the second part of the connector intended to complete view 3B, a view 3E showing the main beam intended to be connected to the two cross beams of 3A and 3B, FIG. 4: a complete connector with its two parts assembled, viewed on each of its two faces, 4A being a view of its free face, i.e. of the face not butted against the cross beam, and 4B being a view of its opposite face intended to be butted against the cross beam, and FIG. 5: a schematic view of marked apertures of a beam, according to an illustrative example.

FIG. 1 depicts the latticework of a metal framework 1 made up firstly of parallel main beams 2 attached by hangers 3 to a main structure, not depicted, generally the ceiling of a room or of a storey of a building, made up secondly of secondary beams or cross beams 4 which are parallel to one another and perpendicular to the main beams 2 and connected to the main beams at each point identified by a circle in the figure. In the spaces of the latticework of this metal framework 1 there are tiles 5 the same size and shape as the spaces, and intended to form a false ceiling some distance from a main ceiling which has not been depicted. In one alternative form, which is commonplace because it reduces the number of hangers to be adjusted for correctly balancing the metal framework 1 and therefore at the same time reduces cost, when the loads to be borne are not great, the spacing between the bearing beams 2 is increased and longer cross beams tailored to this longer spacing are used, these cross beams themselves being spaced apart by cross beams 4 of normal length running in the direction of the bearing beams 2. This other set up is the conventional one used for tiles 5 measuring 60 cm×60 cm: the bearing beams are then spaced 120 cm apart and spaced apart with cross beams running perpendicularly and lengthened to 120 cm, said lengthened cross beams themselves being spaced apart by cross beams 4 of the normal length of 60 cm, this time running parallel to the bearing beams 2, to form spaces in the metal framework 1 measuring 60×60. This alternative form has not been depicted in FIG. 1.

FIG. 2 again shows a portion of a main beam 2 viewed from beneath and elements of two cross beams 4 (4*a* and 4*b*), the element 4*a* being already connected to the main beam 2 and the element 4*b* being offered up to the main beam 2 in the continuation of the adjacent cross beam part 4*a*, on the opposite side from the element 4*a*, with a view to connection. The main beams 2 and the secondary beams or cross beams 4 have the overall cross-sectional shape of an inverted T, the false-ceiling tiles 5 being supported by the sole that forms the flanges of the T of the main beams 2 and of the cross beams 4, and the attachment between the main beams 2 and the hangers 3, which have not been depicted in this FIG. 2, is via the stem of the T of the main beams 2, said hangers being hooked into holes, not depicted, pierced in these stems of the T or being attached otherwise using an accessory suited to the shape of the T and not depicted. The main beams 2 are also pierced periodically in their part that forms the stem of the T, with apertures 7 intended for connection with the ends of the cross beams 4. For the purposes of this connection, each end of a cross beam 4 is fitted with a connector 8 secured to said cross beam 4, notably using plunge joints or rivets 9. This FIG. 2 shows the cross beam 4*a* positioned behind the main beam and of which the connector, which has been passed through an aperture 7,—and which will be given the reference 8*a* because it is associated with the cross beam 4*a*—, reemerges on the visible front face of the main beam 2. To encourage support of the cross beams 4 by the main beams 2, the sole of the cross beams is bent over slightly at its end, allowing it thus to overlap the sole of the beam 2 by about 2 or 3 mm in order to press thereon.

Insofar as a metal framework 1 is produced according to the alternative form mentioned earlier with certain cross beams 4 running parallel to the main beams 2 and which connect to other cross beams running perpendicularly, the connection remains identical in principle and in operation: the cross beams running parallel to the bearing beams 2 are equipped with connectors at their ends and they enter apertures identical to the apertures 7 mentioned hereinabove and connect therein, but this time these apertures are pierced in the secondary beams or cross beams perpendicular to them and which will support them. Interconnection with the connector 8 of the other cross beam parallel to the main beams and contiguous with this first cross beam occurs in exactly the same way, whether the aperture 7 is in a main beam 2 or in a cross beam. Since the connection is the same in this alternative form in which the main beams and the cross beams are no longer systematically perpendicular to one another, the remainder of the description will not return again to this alternative form, it being understood that it too forms an integral part of the invention.

FIG. 3 shows the same elements as FIG. 2 but in greater detail. As before, the references of these elements will be assigned suffixes a (or b) according to whether these elements will be attached to a cross beam 4 with the suffix a (or b). This FIG. 3 is made up of 5 parts:

3A which shows one end of a cross beam 4*a* arranged to the right of the figure and on which the first part 10*a* of a connector 8*a* is mounted, which first part will be termed hereinafter the primary clip 10*a*,

3B which shows one end of a cross beam 4*b* arranged to the left of the figure, on which the first part 10*b*, or primary clip 10*b*, of a connector 8*b* is mounted. This cross beam 4*b* is intended to align with the cross beam 4*a*,

3C which shows the second part 11*a* of a connector 8*a*, which second part will be referred to hereinafter as secondary clip 11*a*,

3D which shows the second part 11*b*, referred to hereinafter as the secondary clip 11*b*, of a connector 8*b*,

3E is a schematic view of a main beam 2 pierced with one of its apertures 7 which is intended to accept the two opposing connectors 8*a* and 8*b* in order to secure the two cross beams 4*a* and 4*b* to this main beam and connect them together.

The connectors 8*a* and 8*b* are identical. Each cross beam is equipped with a same connector 8 at each of its ends, fixed to one of the faces of the stem of the T of the cross beam at one of the ends, fixed to the other face at the other end. Thus, the connector 8*a* shown is fixed to the visible front face of the cross beam 4*a* whereas the other connector 8, not depicted, at the other end of the same cross beam 4*a* will be on the non-visible opposite face. In the same way, the connector 8*b* is on the non-visible rear face of the cross beam 4*b* whereas at the other end, not depicted, of the same cross beam 4*b*, the connector 8, likewise not depicted, is on the front face like the connector 8*a*.

According to the invention, each connector 8 comprises two parts: a primary clip 10 which is fixed for example by plunge joints or rivets to the end of the cross beam 4 and a secondary clip 11 fixed to the primary clip 10 by a means that melts at a low temperature, notably chosen to be below 300° C., suited to the conditions in which the false ceiling is to be used. The fusible means that melts is, for example, a tin-based braze material.

The primary clip 10 keeps the cross beam 4 resting firmly against the main beam 2 and keeps the interconnection with the connector 8 of the adjacent cross beam in the same alignment firm. It is also designed to withstand bending and be able to remain in alignment with the cross beam despite the loadings experienced, particularly those that may result from its insertion into the aperture 7 of the main beam 2 rather carelessly in an action of the "stabbing" type. For that reason it is made of a material that guarantees this robustness. A steel approximately 0.4 mm thick with a high mechanical strength is very suitable. To prevent it from corroding, it is advantageously covered with a protective coating of the electrogalvanized, bichromate or galvanizing type. As has already been stated, this primary clip 10 is intended to be secured firmly to the end of its cross beam 4, for example by plunge joints or rivets 9, preferably not aligned with one another in order further to increase the robustness of the attachment of the connector to the beam. This primary clip is mounted on its cross beam in such a way as to protrude beyond the end of said cross beam substantially in the proportions illustrated in FIG. 3. It has a rounded front face more or less forming a semicircle to make its insertion in an aperture 7 of the main beam 2 easier, even when it is offered up at an angle of as much as 10 or even 20° with respect to said main beam 2. At the ends of the circular arc, the rounded front portion 12 ends in two notches, one of them, 13, on the top of the primary clip 10 and the other of them, 14, which is wider, at the lower part, the notch 14 being slightly offset from the notch 13 and further from the rounded front portion 12 than the notch 13. The notch 14 is elongate and its length determines the amount of clearance needed to absorb the thermal expansion of the beams in the event of a fire. In a fire, the temperature may gradually reach around 1000° C. and that is therefore the temperature to which the various parts of the metal framework will be subjected. Since the coefficient of expansion of steel is around $12\times10^{-6}$, a cross beam 1200 mm long will therefore expand by about 14 mm, which makes 6 mm to be absorbed at each end on each of the connectors at the two ends of the cross beam. A 600 mm cross beam will expand by only 7 mm, making 3.5 mm to be absorbed by each connector. Bearing in mind that not all of the expansion will have to be accommodated by the connectors at the two ends, given the slight softening of the system as a whole, it may be considered that a clearance of 4 or 5 mm, and therefore a notch length of 5 mm or even 4 mm for the notch 14 will be enough for connectors arranged at the two ends of 1200 mm cross beams. A fortiori, this clearance will be enough for connectors fitted to shorter cross beams, notably 600 mm cross beams. Further, given the fact that the steel of the primary clips is far tougher than the metal of the beams, if there were any slightly greater thermal expansion, the beam would be punched slightly by the primary clip before the framework deformed. A longer notch 14 measuring 7, 8 or even 10 mm, which allows greater travel in the event of a fire after the secondary clip has become detached is possible, although this lengthening might weaken the primary clip slightly. In any event, in the case of such an elongation, this potential weakening could be compensated for if necessary by adapting various other factors, including those already mentioned such as the thickness, the nature of the metal, reinforcements such as folds, ribs, etc.

The maximum height of the primary clip 10 at the end of its rounded portion and just before the notch 13 is of the order of the height of the aperture 7 or slightly less than around 0.1 mm or 0.2 mm. Following on from the notch 13 on the upper part of the primary clip 10 there is a cut 15 separated from the notch 13 by a rounded hump 16, then bounded by a vertical edge 17. It is in the region of this vertical edge 17 that the primary clip 10 adopts its maximum height substantially greater than the height of the aperture 7. The primary clip 10 is pierced at its center with two recesses, 18 near the front 12 and 19 further towards the rear. The region separating these two recesses 18 and 19 is pressed near the recess 19 to create a protrusion 20 on that face of the primary clip 10 that is in contact with the cross beam. On the primary clip 10*b* shown in FIG. 3B, the face in contact with the cross beam is the visible face, so it is therefore on this face that the protrusion 20 appears. The primary clip 10 is also provided with means such as folds, ribs or bulges, such as the longitudinal bulge 21 depicted, which stiffen it and give it thickness. The front of this primary clip also has two bosses 22, 23 appearing on that face of the primary clip 10 that is not intended to be in contact with the cross beam. Thus, in FIG. 3A, these bosses 22, 23 are on the visible face; by contrast, on the primary clip 10*b* of FIG. 3B, these bosses are on the face that is not visible and because they are created by pressing, two slight hollows are visible on the visible face, these being the mark of the bosses and bearing the same references 22 and 23.

FIGS. 3C and 3D show secondary clips 11*a* and 11*b* each of which constitutes the second component of a connector 8*a* and 8*b* respectively. The secondary clips 11*a* and 11*b* are identical and are intended to be associated with their respective primary clips 10*a* and 10*b* by being fixed to each of the free faces of said primary clips, which is to say to those faces that are not intended to be in contact with their cross beams 4*a* and 4*b* respectively. For preference, the secondary clips are made of steel. As already stated, each secondary clip is associated with its primary clip 10 by a brazed joint which melts at a temperature suited to the conditions likely to be encountered, particularly a temperature below 300° C. and in general of around 200-250° C., achieved for example by heating with a resistive element or by laser or induction heating. The secondary clips 11 are mechanically less strong than the primary clips 10, their thickness is smaller than that of the said primary clips 10: a thickness of the order of 0.3 mm is suitable in the case of a steel with a high elastic strength, giving these secondary clips 11 the required elasticity for connection and for the robustness of the connection. To prevent them from corroding, a galvanized or electrogalvanized coating is applied. A secondary clip 11 as shown in FIGS. 3C and 3D is a component that has a three-dimensional shape. For example, the secondary clip 11 is cut by a slot 30 over two-thirds of its height approximately, thus separating a rear part 31 from a front part 32. The front part 32 is bent away from the plane of the rear part 31 by an angle of to 25°; it tapers on its very front 33 and is shaped to come nearer to the main clip and therefore to the plane of its rear part 31 to encourage it to slip through the apertures 7. This front part 32 has a protrusion 34 the evolution of which is gradual and at a gentle slope when a finger is slid along it from the front to the rear of the secondary clip, but on the other hand is abrupt and creates an end stop when the finger is slid in the other direction from the rear forward. According to one embodiment, this protrusion 34 is a flange resulting from an outward bending of the top of this front part 32 and the width of which increases progressively from the front rearwards to end abruptly and form an end stop viewed from the rear/front direction. According to another embodiment, this protrusion 34 is formed from imprinting from the opposite face, thus creating a change in level which rises progressively in a gentle slope where a finger is slid along it from the front to the rear, this slope being interrupted by a slot which forms an abrupt edge and an end stop when the finger is slid in the opposite direction. A protrusion 35 bulging in the opposite direction to that of the protrusion 34 is created in the rear part 31 of the secondary clip by a slot and two folds. As already stated, this secondary clip 11 is secured to the primary clip 10 by the rear of its base 36, the region of its rear part 31 situated below the protrusion 35, so that said base 36 of this secondary clip situated under the slot 30, which is a solid part, fills the bottom notch 14 of the primary clip 10 in the lengthwise direction thereof and even in the heightwise direction extends further down than the edges of said notch 14. Thus, when the secondary clip 11 is fixed to a primary clip 10, the front edge of this base 36 constitutes an end stop at the end of the bottom of the rounded portion 12 at the front of the primary clip 10.

When joined together, the primary clip 10 and the secondary clip 11 constitute a three-dimensional assembly because of the bent away front part 32 of the secondary clip the thickness of which is relatively great when no stress is applied to this bent away front part 32, but which can be reduced under load. The shapes, dimensions and configuration of the secondary clip 11 are such that once assembled with its primary clip 10, the tapered tip 33 of the front part 32 of the secondary clip is slightly set back by around 1 mm from the very front end of the rounded portion 12 of the primary clip. Also, said tapered tip 33 is positioned between the two bosses 22 and 23 of the primary clip 10 and the top of these two bosses protrudes heightwise beyond the free surface of this point, thus protecting it from any knocks during the connection operation.

FIG. 3E shows a portion of a main beam 2 with an aperture 7. The apertures 7 are in the overall shape of a diamond or, more specifically, a double trapezium, the two trapeziums being superposed, of height equal to the maximum height of the rounded front portion 12 of the primary clip 10 of the connectors. The maximum width of the aperture 17 is such that it allows two connectors 8 positioned head to tail to pass through, their two bent apart but elastic portions 32 being able to flatten to bring them closer into the plane of the portions 31 of the secondary clips.

The two views 4A and 4B of FIG. 4 again show a complete connector 8 comprising its two constituent parts, its primary clip 10 and its secondary clip 11, assembled. View 4A shows the free face of the connector which remains visible when it is assembled at the end of a cross beam. This view 4A again shows the elements of the connector 8 that have already been shown, namely essentially the primary clip 10 and, resting against said primary clip 10, the secondary clip 11, both as already stated being joined together by a fusible means such as brazed material. In the rear part of the primary clip 10 it is possible to make out the two holes which will accept the plunge joints or rivets 9. The rounded portion 12 of the front part of the primary clip 10, its bosses 22 and 23, one of the two recesses 18, 19, in this instance the one referenced 18 which is the one furthest forward, the bulge 21 intended to increase the rigidity, the notch 13, then the cut 15 on the top edge of the primary clip 10, are clearly visible. As far as the secondary clip 11 is concerned, its position relative to the primary clip 10 with its front part 32 bent away from the plane of its rear part and at the same time from the main plane of the primary clip 10 may be seen; it is also possible, thanks to the perspective angle from which this view 4A is viewed, to see how its tapered tip 33 is positioned between the two bosses 22 and 23 of the primary clip 10, how it comes closer to the plane of the primary clip 10 and how by bending it forms the protrusion 34 with an edge at a gentle slope. This same FIG. 4A also shows the base 36 of the secondary clip 11 which plugs the notch 14 of the primary clip 10, which notch is therefore not visible in this view 4A. Thus, the length of the notch 14 is filled by the secondary clip 11, as this has the effect of reducing and even eliminating the clearance allowed for a connector connected into the aperture of a beam.

FIG. 4B shows the other face of the connector 8, the face intended to press against the cross beam 4. The overall shape of the connector and, in particular, of the primary clip 10 essentially visible on this face, the two holes for attachment to the cross beam by plunge joints or rivets 9, the mark of the bulge 21 as a hollow on this face, the recesses 18 and 19, the notch 14, the protrusion 20 and those parts of the associated secondary clip 11 which are visible through the recess 19 and through the recess 18 or which protrude beyond the primary clip, notably the tip 33 of the tapered part of the front 32 of the secondary clip and the protrusion 35 of the rear part thereof consisting of a slot and two folds, can be seen in this figure.

The invention has been described with a notch 14 at the lower part of the periphery of the primary clip 10 but a configuration in which the notch is in the upper part is also covered by the invention. In this alternative form, the secondary clip is then arranged in such a way as to be able to fill this notch.

When manufacturing a framework for a false ceiling, the system as described hereinabove works as explained below. First of all, the main beams 2 are arranged parallel to one another and anchored to the ceiling by the hangers 3. Next, the ends of the cross beams bearing the connectors 8 are "stabbed" into the evenly spaced apertures 7. To make it easier to insert into the correct point from among the multitude of apertures 7 in the main beams and prevent the need to count off how many apertures 7 there are to be between two adjacent cross beams, the apertures are marked, notably by engraving, inkjet printing or the like, with the size of tile 5 (the common sizes are 600, 625, 675 mm) as the period of the series of marked symbols. As shown for example in FIG. 5, if the tile size contains six apertures, they will be numbered with a sequence 1, 2, 3, 4, 5, 6, this sequence then repeating facing the next apertures along the primary beam 2. The fitter who has connected the secondary beam or cross beam 4 under the number 3 for example, will simply need to connect the other cross beams 4 parallel to one another under the same number, thus avoiding any individual counting of apertures. The sequences are written from left to right on each face of the primary beam 2 with the same starting number on each left-hand end of this primary beam 2. Thus, one side reads 1, 2, 3, 4, 5, 6,/ . . . /1, 2, 3, 4, 5, 6 from left to right, and if the beam is rotated through 180° about a vertical axis passing through its center, the same thing will feature from left to right on the other side. This situation is made necessary by the fact that the beam 2 can be mounted in sequence with a rotation by 180° with respect to this vertical axis without that altering the result of the assembly obtained.

When a connector 8 at the end of a cross beam 4 is thrust into an aperture 7, its entry and penetration are made easier by the fact that the front end of the primary clip 10 which is first to come into contact with a main beam 2 is rounded, thus preventing the connector from dropping too far down in the aperture 7 and also preventing the sole of the cross beam 4 from striking that of the perpendicular main gbeam 2, and finally because the tapered end of the front 32 of the clip is brought closer to the rounded front part of the primary clip 10. It is impossible for the tapered front part 32 of the clip 11 to knock either against the walls of the aperture or against the other connector intended to be inserted into the same aperture 7, because this tapered front part is protected by the two bosses 22 and 23 which flank it, which protrude further beyond the said tapered part and because it is shorter than the primary clip 10. As entry into the aperture 7 continues, the external face of the front of the clip comes into contact with the lateral edge of the aperture 7, then it is the edges of the protrusion 34 which, pressing against the edge of the aperture 7, force the spring-effect elastic front part 32 of the secondary clip to flatten slightly; then, as penetration progresses still further, the notch 13 of the primary clip 10 of the connector at the same time becomes immobilized in the very top part of the aperture 7 and the protrusion 34 protrudes beyond the lateral wall of the aperture 7. Because of the elasticity of the front part of the front part 32 of the clip and the abrupt edges of this side of the protrusion, the connector finds itself immobilized and prevented from moving back. The top of the aperture is then immobilized in the notch 13 and the bottom part of the rounded portion of the front face 12 of the primary clip 10 is very close to the aperture. The connector and the cross beam attached to it are therefore immobilized in the aperture 7. The main beam supports the cross beam and, even with no support at the other end, the cross beam is held in position, cantilever fashion. Just prior to immobilization, the gradually sloping fold of the protrusion 34 rubs against the lateral wall of the aperture 7, forcing the elastic front part 32 of the clip to flatten progressively and, at the moment of immobilization, because the edge of the protrusion 34 is suddenly overshot, the elastic part 32 of the clip relaxes and therefore produces a metallic noise or "click" which is the information that validates correct clipping of the connector into the aperture 7. This "click" is the result of the metallic nature and elastic properties of the clip.

When the second cross beam 4 to be aligned with the first already installed is offered up to the other face of the main beam 2 and begins to enter the aperture 7, the two faces of the connectors 8 which have no clips slide against one another. The forward movement of this second cross beam and its immobilization in the aperture 7 occur as explained in respect of the first cross beam. In addition, the two cross beams interconnect with one another. The two elastic portions of the clips 11 collaborating with the lateral edges of the aperture 7 keep the two connectors pressed against one another. The end stops formed by the protrusions 20 bear against the front wall of the recess 18 of the opposite connector. The high strength of the steel of the primary clips 10 of the connectors, the elastic pressure applied by the secondary clips, and the bulges 21 having a size that causes them to press against the lateral walls of the aperture 7, all contribute to keeping the connectors firmly connected to one another via their protrusions 20 and their recesses 18.

If need be, in order to remove the connector when it is on its own in the aperture 7, the elastic part 32 of the secondary clip 11 needs to be pressed by hand in order thus to disengage the lateral part of the aperture 7 from the stop that the protrusion 34 constitutes.

In order to remove the connector when it has already been interconnected with its parallel counterpart facing it in the aperture 7, the elastic part 32 must be pressed by hand and the cross beam thus held twisted upward about the axis formed by the main beam so that the protrusion 20 can escape contact with the hole 18, this beginning at the start of the rotational movement through the fact that the upper boss 22 protrudes beyond the hole 18, allowing it to ride more easily up the protrusion 20 of the connector opposite. This dismantling can be done effortlessly and with no damage to the connectors or to the beams.

The metal framework thus created is capable of withstanding significant tensile loadings in excess of kilos, and various vibrations, thus preventing it from being damaged in the event of such vibrations and making it suitable for use in earthquake areas. This superior performance is a result of the interconnection between two aligned cross beams at their respective connectors fitted into one and the same aperture that allows the tensile loading to be spread across all the connections with the main beams along each line of cross beams, and also results from the firmness of these connections which is due to the robustness of the metal of the primary clips, to the spring effect of the secondary clips which effect presses together the two connected primary clips in order to keep them firmly connected, and to the absence or near-absence of clearance under normal circumstances.

In the event of a fire, the secondary clips 11 secured to their primary clips 10 detach when 200-250° C. is reached. The result of this is that the base 36 of the secondary clips uncovers the notch 14 and that the end stop 35 which is blocking the front of the primary clip of the opposite connector ceases this blocking action. Under the longitudinal thrust resulting from thermal expansion caused by the fire, the connectors penetrate a little further into the apertures 7, the humps 16 of the primary clips 10 of the connectors no longer form an obstacle to this progression insofar as the notches 14 compensate for the height of said humps 16. The apertures 7 are therefore located in the region of the cut 15 on the top of the primary clip 10 and in the region of the notch 14 on the bottom of the same primary clip 10. Both the cut 15 and the notch 14 have a certain length of the order 4 or 5 mm which allows the connectors to penetrate further into the apertures which means that expansion can continue without risk to the integrity and intactness of the framework which therefore remains correctly aligned thus preventing the tiles 5 from falling out and thus protecting the structure and the ceiling above.

The fact that the connector is produced in two parts means that each part can be better specialized by choosing its composition, its treatment and its shape without being limited by restrictions imposed by the other part.

Thanks to the combination of the primary clip that allows a relatively large amount of clearance with the secondary clip that reduces this clearance for operation in normal service, it is possible for thermal expansions caused by fire to be absorbed without impairing the stability, precision and solidity which are needed for an esthetically attractive solution.

An interconnection clearance of as little as 0.2 or even 0.1 mm is thus possible. It is also advantageous to preserve this small clearance in order to absorb any manufacturing variations on the beams and prevent these variations from adding up and causing the grid spacing of the ceiling to deviate.

The invention claimed is:

1. A ceiling framework comprising:

main beams and cross beams, which are connected to one another and transversally to one another by connectors borne by one type of beams among the main beams and the cross beams, and engaged in apertures made in the other type of beams among the main beams and the cross beams, so as to receive tiles, wherein, for each beam having the apertures, the apertures are marked with symbols on each face of the beam, the symbols marked on each face being repeated sequentially over a length of the beam, a period of a sequence of the symbols on each face spans a size of one tile of the tiles, and each of the apertures in a length of the beam corresponding to the period is marked with a different one of the symbols for each observed face, and wherein the symbols are the same on either face of the beam, starting with a same symbol on each left-hand or right-hand end for each observed face.

2. The ceiling framework as claimed in claim 1, wherein the apertures are made in the main beams.

3. The ceiling framework as claimed in claim 1, wherein a spacing between two identical symbols of two contiguous sequences is equal to the size of the one tile.

4. The ceiling framework as claimed in claim 1, wherein each beam having the apertures has various sequences of symbols, and periods of the various sequences span various tile sizes.

5. The ceiling framework as claimed in claim 1, wherein the symbols are marked by engraving or inkjet printing.

6. The ceiling framework as claimed in claim 1, wherein the symbols are numbers.

7. The ceiling framework as claimed in claim 1, wherein, for each beam having the apertures, the apertures on one face of the beam are marked with a repeating sequence 1, 2, 3, 4, 5, 6/ . . . /1, 2, 3, 4, 5, 6 from left to right, and when the beam is rotated through 180° about a vertical axis passing through its center, the same repeating sequence 1, 2, 3, 4, 5, 6/ . . . /1, 2, 3, 4, 5, 6 is marked from left to right on the other face of the beam.

8. The ceiling framework as claimed in claim 1, wherein, for each beam having the apertures, sequences of symbols are written from left to right on each face of the beam with a same starting symbol on each left-hand end of the beam.

9. The ceiling framework as claimed in claim 1, wherein the main beams are provided with the apertures, some of which are used to connect the cross beams, and wherein, for a given tile size, all connections between the main beams and the cross beams are made in apertures marked with a same symbol corresponding to the given tile size used, avoiding a necessity of counting a number of the apertures between two adjacent cross beams.

10. The ceiling framework as claimed in claim 1, wherein each connector is configured to make a connection according to a stab-in system and comprises two parts that include a primary clip as a first part of the two parts and a secondary clip as a second part of the two parts, which are fastened to one another via a fusible part configured to melt at a temperature of a fire so as to cause the two parts to separate.

11. A method for manufacturing the ceiling framework as claimed in claim 1, comprising:

for each beam having the apertures, inserting ends of the other transversal beams bearing the connectors in those apertures of the beam which are marked with a same symbol corresponding to the size of the one tile, without counting a number of the apertures provided between two adjacent transversal beams bearing the connectors.

12. The method as claimed in claim 11, wherein each beam having the apertures is one of the main beams and the beams bearing the connectors are the cross beams.

* * * * *